US008192661B2

(12) United States Patent
Lauckner et al.

(10) Patent No.: US 8,192,661 B2
(45) Date of Patent: Jun. 5, 2012

(54) PROCESS AND APPARATUS FOR THE PRODUCTION OF TAPES

(75) Inventors: Joachim Lauckner, Chemnitz (DE); Heinz Kuhnau, Morschen (DE); Jens Weinhold, Hohenstein (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 454 days.

(21) Appl. No.: 11/686,111

(22) Filed: Mar. 14, 2007

(65) Prior Publication Data

US 2007/0200270 A1 Aug. 30, 2007

Related U.S. Application Data

(63) Continuation of application No. PCT/EP2005/010599, filed on Sep. 30, 2005.

(30) Foreign Application Priority Data

Oct. 5, 2004 (DE) ..... 10 2004 048 292

(51) Int. Cl.
*B29C 47/88* (2006.01)

(52) U.S. Cl. ..... 264/146; 264/147; 264/211.12; 425/307; 425/315

(58) Field of Classification Search ..... 264/146–147, 264/210.1, 211.12; 425/307, 315
See application file for complete search history.

(56) References Cited

U.S. PATENT DOCUMENTS

| | | | | |
|---|---|---|---|---|
| 5,928,579 | A * | 7/1999 | Spahlinger et al. | 264/40.1 |
| 6,174,474 | B1 * | 1/2001 | Stein et al. | 264/129 |
| 6,439,498 | B1 * | 8/2002 | Hufschmidt et al. | 242/471 |
| 2005/0151295 | A1 * | 7/2005 | Schemken et al. | 264/168 |

FOREIGN PATENT DOCUMENTS

| | | | |
|---|---|---|---|
| DE | 198 43 428 | A1 | 9/1998 |
| DE | 10241371 | A1 | 9/2002 |
| EP | 1 095 892 | A2 | 10/2000 |
| JP | 10018122 | A * | 1/1998 |
| WO | WO 99/41180 | | 8/1999 |
| WO | WO 03/033386 | A1 | 10/2002 |
| WO | WO 2004018751 | A1 * | 3/2004 |

OTHER PUBLICATIONS

English abstract of JP 10018122, 1998.*

* cited by examiner

*Primary Examiner* — Christina Johnson
*Assistant Examiner* — Xue Liu
(74) *Attorney, Agent, or Firm* — Alston & Bird LLP

(57) ABSTRACT

A process for the production of tapes from a web of polymeric material, as well as an apparatus for carrying out the process, in which a polymer melt is extruded to form the web, which is then cooled, and drawn off. The web is then cut to form a tape sheet composed of a plurality of tapes. According to the invention, before its drawing, the sheet of tapes is divided into several groups of tapes and drawn separately. For this, a drawing device is provided with which the tapes are drawn separately after division of the sheet of tapes.

21 Claims, 4 Drawing Sheets

PROCESS AND APPARATUS FOR THE PRODUCTION OF TAPES

CROSS REFERENCE TO RELATED APPLICATION

This is a continuation of international application PCT/EP05/10599, filed Sep. 30, 2005. The disclosure of said application is incorporated herein by reference.

BACKGROUND OF THE INVENTION

The invention relates to a process for the production of tapes from a foil web as well as an apparatus for carrying out the process.

A generic process and a generic device are known from EP 1 095 892 A2 and corresponding U.S. Pat. No. 6,439,498.

In the known process and the known device a foil web is extruded from a polymer melt, cooled, and drawn off to a cutting device. In the cutting device the foil web is cut into a plurality of ribbons (referred to herein as tapes). The tapes are subsequently drawn together as a tape sheet and individually wound onto spools. The process according to the invention and the device according to the invention are thus particularly suitable for producing a plurality of tapes of the same type and quality from a foil web.

In DE 102 41 371 A1 a process and a device are described in which some of the tapes are separated before winding into a subgroup which receives a special treatment. With this, the production of tapes is improved in such a manner that at least one subgroup of the plurality of tapes can be produced in a configuration which is different in a manner predetermined by additional treatments. Here all the tapes are drawn together as one tape sheet so that the additional treatment can take place either before or after the drawing.

The processes and apparatus known in the state of the art for the production of tapes from a foil web are thus based on the fact that the drawing of tapes is done according to the active principle of drawing a sheet.

Sheet drawing of this type can however only be executed reliably at relatively low operating speeds since at high speeds fiber breakage, problems in handling, and in particular problems of sympathetic breakage of adjacent tapes occurs.

It is thus the object of the invention to provide a process and an apparatus of the type described above for the production of tapes from a foil web in such a manner that the tapes can be produced from the foil web at as high a production speed as possible.

An additional object of the invention lies in increasing flexibility in the production of foil tapes. In particular, along with this, an object of the invention is to provide a process and an apparatus with which tapes can be produced with different product properties.

SUMMARY OF THE INVENTION

The invention distinguishes itself by the fact that the number of tapes drawn simultaneously by a drawing unit can be reduced to a size adapted to the production speed and the handling. For this, the sheet of tapes is divided, before its drawing, into several groups of tapes which are drawn separately and independently of one another. For this, the device according to the invention comprises a drawing device formed of several drawing units, where, with the drawing device, the tapes can be drawn separately after division of the sheet of tapes. Depending on the number of drawing units provided, the tapes can thus be drawn individually or in groups. The invention thus provides new production possibilities in the processing of a foil web into foil tapes. The process according to the invention and the apparatus according to the invention permit a doubling of the previously known production speeds up to 1,000 m/min.

The processing variant in which each group of tapes is drawn by individually predefined setting parameters distinguishes itself in particular by the fact that, from a predefined foil property, tapes can be produced with different product properties. Thus, different strengths of the tapes produced can be achieved by different drawing ratios. With this, tapes for different applications can be produced from one foil web in one process on one device. As setting parameters here the drawing ratio or the temperature regulation of the tape for drawing can be predefined and set.

Likewise, with this there is the possibility of cutting the tapes of the group of tapes to individually predefined cutting widths. The production of tapes with different titers in one process can thus be carried out in a simple manner.

The flexibility of production of the tapes can be improved by the process variant in which at least one of the groups of tapes receives, before its drawing, during its drawing, or after its drawing at least one additional treatment. Thus, a fibrillation, a regulation of temperature, or a preparation can be carried out as an additional treatment on a group of tapes, individually or as a group. Likewise, subsequent drawing, thermofixing, or relaxations can be carried out as an additional treatment on one or more groups of tapes.

The process according to the invention thus distinguishes itself by the fact that from one foil web different groups of tapes for different applications can be produced at maximum production speed. Along with this, there is the possibility of producing tapes with different titers and different product properties with regard to strength, extension, and shrinkage as well as with or without additional treatment.

In order to be able to set individual settings for the drawing of the groups of tapes, the extension of the device according to the invention is particularly advantageous in which the drawing units can be driven and controlled independently of one another by separate drives. In this respect, for example, high-strength tapes with a high degree of drawing and tapes with high extensions and relatively low drawing can be produced from one foil.

Depending on the division and assignment, several winding units of the winding device can be assigned to each drawing unit, or to each only one winding unit of the winding device. In particular in the case that one drawing unit and one winding unit are used per tape, the use of small assemblies which simplify handling at high speeds is made possible.

In order to be able to carry out the group and individual handling of the tapes without an effect on the preceding treatment of the sheet of tapes, according to a particularly preferred extension of the invention a fiber brake device is assigned to each of the drawing units, with which fiber brake device the feed of the tapes to the individual drawing units can be adjusted. In addition to this, the possibility of individual setting of the drawing units is supported thereby.

In the division of single tapes, or a few tapes, on one drawing unit, the drawing units can be formed in an advantageous manner by several galettes or galette units consisting of a galette with a roller, where at least one of the galettes is formed in such a manner that it can be heated. With this, the regulation of the temperature of the tapes is possible in a simple manner. Additional heating devices between the drawing units or galettes can thus be avoided.

In order to make possible a compact mode of construction in a complete system for the production of tapes, the galettes and galette units of the drawing units are preferably held one next to another and/or one over another on a wall of the supporting frame.

Here the wall of the supporting frame preferably has a modular design, where the modules are formed as carriers for drawing units and as carriers for winding units. With this, flexible assembly, possible changes in construction, and the incorporation of additional assemblies is possible in a simple manner.

The separation of the tapes is done in an advantageous manner immediately after the cutting of the tapes. For this, a fiber guide bar with a plurality of fiber guides is assigned to the cutting device.

To increase flexibility in the production of tapes of different product properties the extension of the device according to the invention is preferably used in which additional treatment devices are assigned to at least a part of the drawing units. As treatment devices it is possible to provide, for example, spiked rollers for fibrillation, preparation devices for preparation, heating devices for thermofixing, galettes for follow-up drawing or for shrinkage treatment.

In the production of the foil web the cooling device is preferably formed as a cooling bath to achieve higher production speeds, so that rapid cooling of the freshly extruded foil web is possible. Along with this, several deflecting rods or deflecting rollers are assigned to the cooling bath in an output area in order to spin off the adhering remnants of moisture on the foil by repeated sharp deflection.

Here it has proven itself particularly effective if the deflecting rollers are disposed directly above the cooling bath, where at each deflecting roller there is a sharp deflection of the foil web with an angle greater than 90°. Thereby the liquid can be given off even at high speeds.

BRIEF DESCRIPTION OF THE DRAWINGS

The process according to the invention and the apparatus according to the invention for carrying out the process are described in more detail below, with reference to the accompanying drawings, in which.

DETAILED DESCRIPTION OF THE PREFERRED EMBODIMENTS

Figure 1:
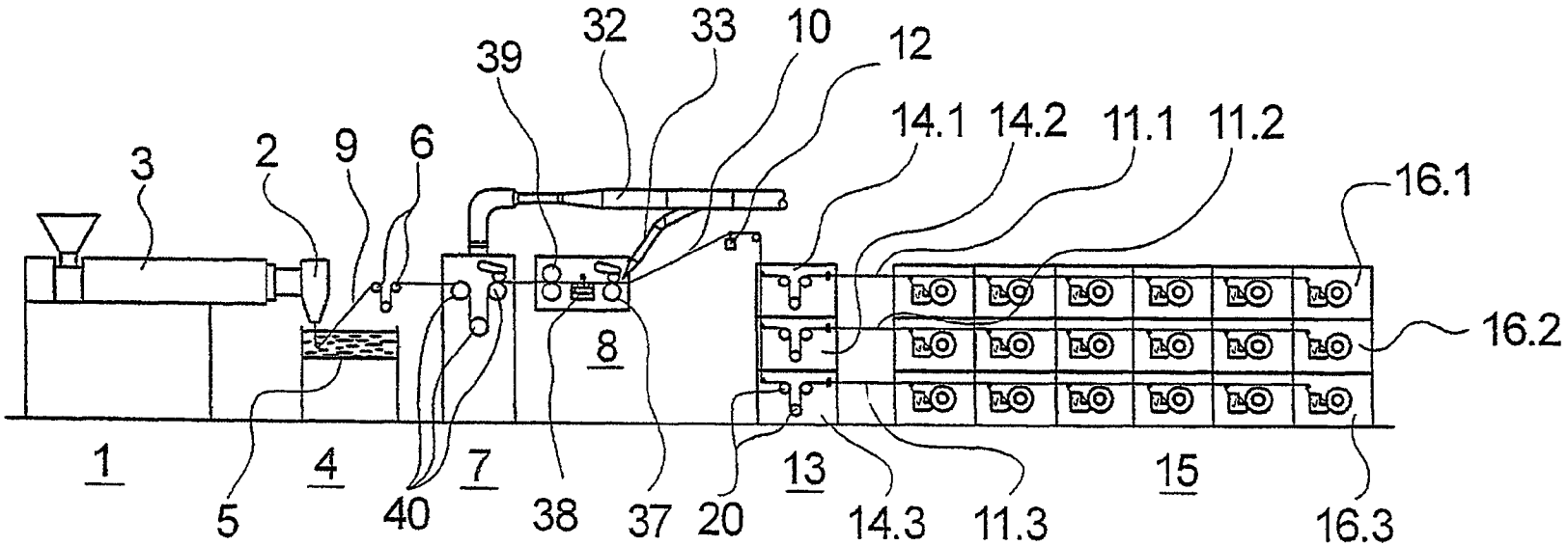
FIG. 1 is a schematic view of a first embodiment of a process and apparatus according to the invention.
Figure 2:
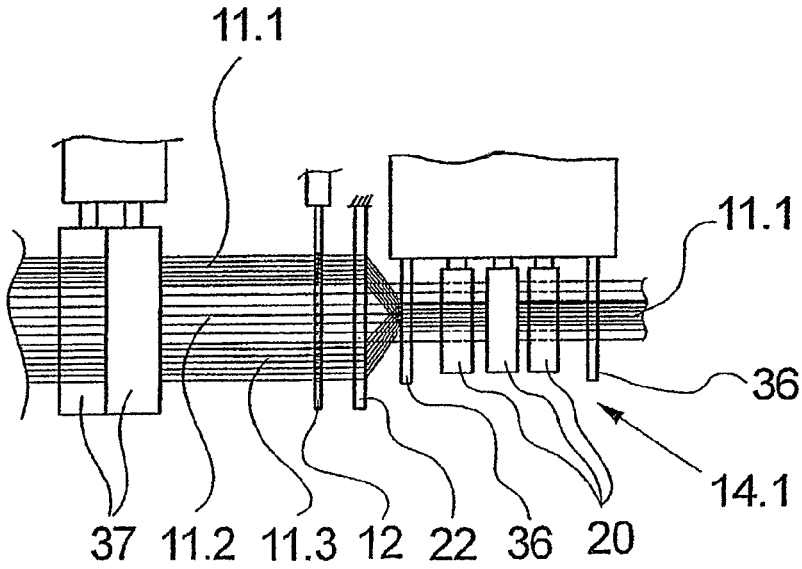
FIG. 2 is a schematic fragmentary view of the tape intake in the drawing unit of the embodiment according to FIG. 1.

FIG. 1 and FIG. 2 schematically illustrate a first embodiment of a process and apparatus according to the invention, and which comprises an extruding device 1, a cooling device 4, a draw-off unit 7, a cutting device 8, a drawing device 13, and a winding device 15, which are combined to form a processing path.

The extruding device 1 is formed by an extruder 3 and an extrusion die 2 connected to the extruder 3 on the output side. There, in the extruder direction 1, a polymer granulate is melted in the extruder 3 and extruded at the output end through the extrusion die 2 to form a thin foil web 9.

To cool the freshly extruded web 9, the cooling device 4 is disposed directly at the extrusion die 2. In this embodiment, the cooling device 4 is formed by a cooling bath 5 in which a liquid coolant is contained. There the extruded foil web 9 goes directly into the liquid coolant in the cooling bath 5 so that the foil web 9 is hardened on its surface. During the drawing off of the foil web 9 it is guided, after coming out of the liquid coolant, over several deflecting rollers 6 disposed above the cooling bath 5 in an output area. In this example three deflecting rollers 6 are shown, where the foil web is guided on, with partial enwrapments, their circumferential surface.

For drawing off, the web 9 is guided over several draw-off rollers 40 of the draw-off unit 7 and conveyed to the cutting device 8 disposed after the draw-off unit 7. The cutting device 8 contains a cutter bar 38 with a plurality of cutters which cut up the foil web 9 into a sheet of ribbons or tapes 10. A cutting device of this type is known, for example, from DE 198 43 428 A1 so that at this point reference is made to the document cited.

To guide the foil web or the sheet of tapes an intake roller 39 and an output roller 37 are disposed at the cutter bar.

To draw off the sheet of tapes a drawing device 13 is disposed after the cutting device 8. In this embodiment example the drawing device 13 is formed by three drawing units 14.1, 14.2, and 14.3 disposed one over another in tiers. Between the drawing units 14.1, 14.2, and 14.3 and the cutting device 8 a fiber guide bar 12 with several fiber guides is disposed in order to perform a division of the fiber sheet into several tape groups 11.1, 11.2, and 11.3. After division of the sheet of tapes, one of the drawing units 14.1, 14.2, and 14.3 is assigned to each tape group 11.1, 11.2, and 11.3. In this embodiment example the tapes of the tape group 11.1 are guided through the drawing unit 14.1, the tape group 11.2 through the drawing unit 14.2, and the tape group 11.3 through the drawing unit 14.3. Each of the drawing units 14.1, 14.2, and 14.3 comprises several drawing rollers 20 with which their assigned tapes are drawn. For this, the drawing rollers 20 are formed in such a manner that they are heated. The drawing rollers 20 are driven individually so that individual drawing ratios can be adjusted in the drawing units 14.1, 14.2, and 14.3.

FIG. 2 is a plan view of the drawing device 13 with the tape groups 11.1, 11.2, and 11.3 being fed. The tape groups 11.1, 11.2, and 11.3 are each formed by six tapes 10. In this case the tapes 10 of the individual tape groups 11.1, 11.2, and 11.3 have different widths so that from each of the tape groups 11.1, 11.2, and 11.3 tapes with different product properties can be produced. After the separation of the tapes 10 by the fiber guide bar 12 the tapes 10 are distributed via a guide roller 22 and guide bars 36 onto the individual tiers of the drawing device 13. Each of the drawing units 14.1, 14.2, and 14.3 can be driven and controlled by separate drives so that each tape group can be drawn with individual adjustment parameters.

To regulate the temperature of the tapes before their drawing there is also the possibility of guiding the tape groups 11.1, 11.2, and 11.3, separately or as a group, through heating devices.

As represented in FIG. 1 the winding device 15 with a plurality of winding units 16.1, 16.2, and 16.3 is disposed at the end of the device. The winding units 16.1, 16.2, 16.3, etc. all have an identical design, where in each of the winding units a tape is wound onto a spool. Winding units of this type are known, for example, from WO 99/41180 so that at this point reference can be made expressly to the document cited. Here the winding units can be driven and controlled independently of one another so that tape winding adapted to the drawing ratio is possible.

The winding units 16.1, 16.2, 16.3, etc. are disposed one over another in tiers and in each tier adjacent one to another in groups. Here the winding units 16.1 of the upper tier are assigned to the drawing unit 14.1, the winding units 16.2 of the middle tier are assigned to the drawing unit 14.2, and the winding units 16.3 of the lower tier are assigned to the drawing unit 14.3. Thus, the tapes of the tape group 11.1 are wound onto spools in the winding units of the upper tier of the winding device 15, the tapes of the tape group 11.2 are wound onto spools in the winding units of the middle tier of the winding device 15, and the tapes of the tape group 11.3 are wound onto spools in the winding units of the lower tier of the winding device 15.

To start up the process as well as to discharge torn tapes a suction device 32 is provided which is connected to the draw-off unit 7 and to the cutting device 8. In particular on the output side of the cutting device 8 a suction pipe 33 is formed with which individual tapes are guided off after a break in the tape. The suction pipe 33 is assigned to the output rollers 37 which, as pinch rollers, guide the tape sheet in a pinch spool. Provided to monitor the run of the tape, the fiber stop motion device and fiber discharge device, which can be assigned to the winding units as well as to the drawing units, are not represented here. In addition to this, there is also the possibility of enhancing the suction device 32 in such a manner that a suction pipe is assigned to each of the drawing units.

With, represented in FIG. 1, the embodiment example of a device according to the invention, several groups of tapes of different product properties can be produced in parallel from an extruded foil web by the process according to the invention. Through the division of the sheet of tapes before their drawing, the drawing units assigned to the individual groups can be designed more compactly and in a manner which is more handling-friendly so that greater production speeds become possible. The number of drawing units as well as the number and division of tape is given here as an example.

In order to make possible as high a production speed as possible in the production of tape from a foil, the number of drawing units is preferably chosen to be equal to the number of tapes.

Figure 3:
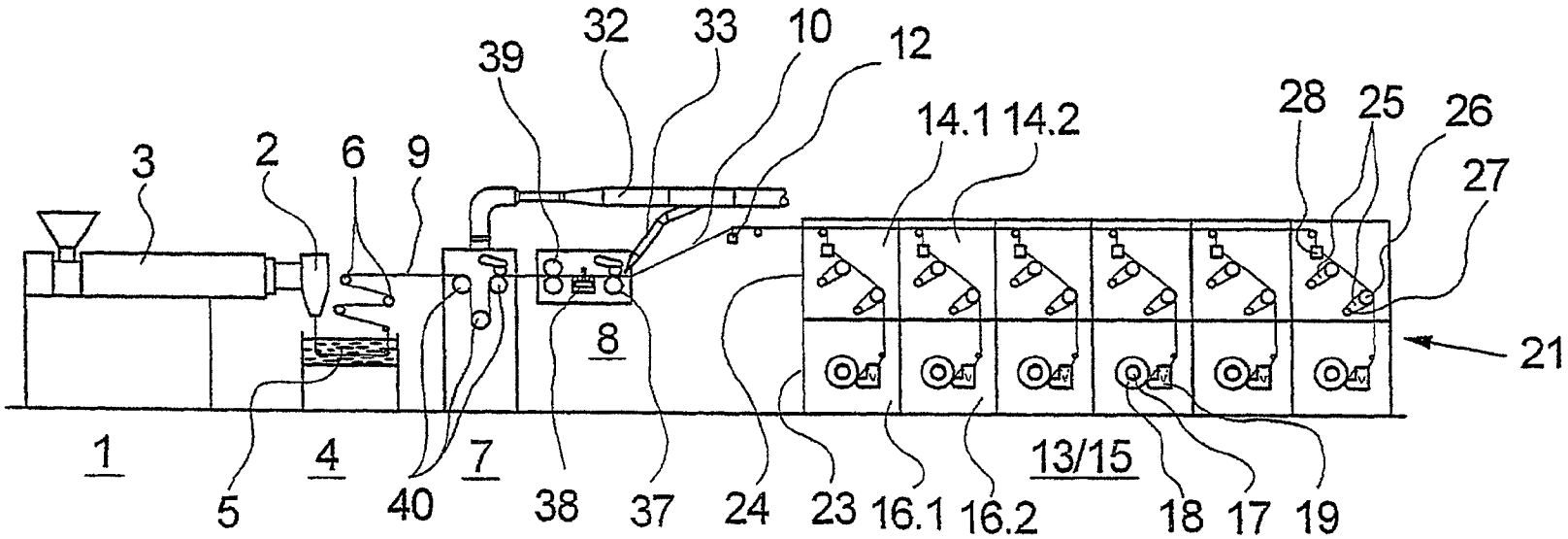
FIG. 3 is a schematic view of an additional embodiment of the apparatus according to the invention.

For this, an additional embodiment example of the device according to the invention for carrying out the process according to the invention is shown in FIG. 3. The embodiment example is essentially identical to the embodiment example according to FIG. 1 so that in the following only the differences are explained and otherwise reference is made to the preceding description.

In order to cool the foil web 9 after extrusion through the extrusion die 2, the foil web 9 is guided through the cooling bath 5. Above the cooling bath 5 a total of three deflecting rollers are disposed at a distance one from another so that the foil web 9 is guided on each of the deflecting rollers 6 with a sharp deflection. In the embodiment example represented the foil web is guided on the deflecting rollers with an enlacement angle of ca. 150°. By so doing, the liquid residues carried along by the foil web are reliably spun off at high production speeds. Through the arrangement of the deflecting rollers 6 above the cooling bath the liquid residues fall back directly into the liquid coolant bath. To that extent the embodiment example according to FIG. 3 is particularly suitable for extrusion and cooling a foil web at high production speeds.

The further course to the drawing off and cutting of the foil web is identical to that of the aforementioned embodiment example according to FIG. 1.

In the device represented in FIG. 3 the drawing device 13 and the winding device 15 are both held on a wall 21 of a supporting frame. For this, the wall 21 of a supporting frame comprises several drawing modules 24 and several winding modules 23. The drawing modules 24 each carry a drawing unit 14.1 and are disposed one next to another in groups in a vertical plane. The winding modules 23 disposed below the drawing modules each carry winding unit 16.1, which, in a group, are held in a vertical arrangement on the wall 21 of a supporting frame. The drawing device 13 and the winding device 15 comprise a total of six units, where to each drawing unit 14.1 a winding unit 16.1 is assigned.

Each of the drawing units 14.1 comprises two galette units 25 which are each formed by a driven galette 26 and an associated roller 27. On an intake side the drawing units 14.1 comprise a fiber brake 28.

The winding units 16.1, 16.2, . . . assigned to the drawing units 14.1, 14.2, . . . are formed in a manner identical to that of the foregoing embodiment example. In this case, in each of the winding units 16.1 a tape is wound onto a spool 18 with an essentially constant tension and uniform circumferential speed. The regulation of the spool spindle 17 is accomplished by means of a dancing arm control unit 19.

In the embodiment example represented in FIG. 3 a foil web 9 is extruded from a polymer melt into a cooling bath 5. After the cooling and drawing off of the foil web 9 it is cut into several tapes 10 and subsequently distributed onto the defined number of drawing units 14.1, 14.2, . . . Through the fiber brake 28 at the intake of the drawing units 14.1, 14.2, . . . a defined pre-tensing of the tapes which is uniform over the number of drawing units 14.1, 14.2, . . . is set. The drawing of the individual tapes in the drawing units 14.1, 14.2, . . . can in this case be done with the same setting parameters or parameters individually predefined for each. For thermofixing the galettes 26 are implemented in such a manner that they are heated. Here it has been found that the temperatures necessary for drawing clearly lie below the values used for drawing a sheet. Along with this, the tapes are each guided, with several enlacements, on the heated galettes 26.

After their drawing, the tapes are wound onto spools 18 in their assigned winding units 16.1, 16.2. Through the individual drawing of the tapes, and the thus compact embodiment of the drawing units, it was possible to achieve a production speed of up to 1,000 m/min with good handling. The production capacity is thus not determined, as before, via an operational width of the foil web but rather only by the output of the extruder.

To carry out the process according to the invention there is in the embodiment example represented in FIG. 3 also the possibility that several drawing units and several winding units are each assigned to one group of tapes and operated with the same settings. Thus, the production of groups of tapes with different product properties and defined individual drawing is possible. The drawing units assigned to a group could be driven by a group drive in this case.

To wind the tapes, winding units can preferably also be used in which a continuous operation is possible by two spool spindles disposed on a turret. A winding device of this type is known, for example, from WO 03/033386. Here two winding points are formed in a turret which are carried alternately into an operating position and an exchange position so that a continuous winding of the tapes is possible.

Figure 4:
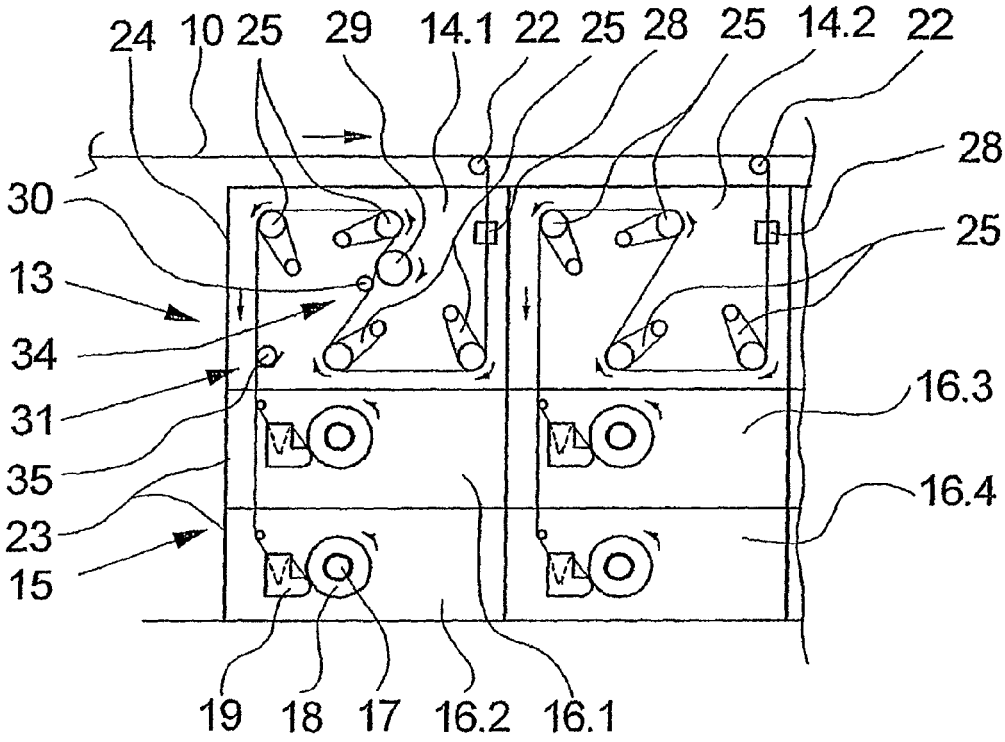
FIG. 4 is a schematic view of an embodiment of a drawing-winding device.

In FIG. 4 an additional embodiment example of the apparatus according to the invention for carrying out the process according to the invention is represented in a partial view. Here the partial view shows a cut-out of a drawing-winding module. For this, a drawing module 24 and several winding modules 23 are held vertically one over another and in horizontal direction each one next to another on a wall of the supporting frame. On a first drawing module the drawing unit 14.1 is held. The drawing unit 14.1 comprises, along with several galette units 25, a fibrillation device 34 and a preparation device 31. The fibrillation device 34 is formed by a spiked roller 29 disposed between two galette units 25 and with a guide roller 30 disposed before it. The preparation device 31 is formed as a preparation roller 35. Two winding units 16.1 and 16.2 are assigned to the drawing unit 14.1 so that two tapes are drawn, fibrillated, and prepared simultaneously by the drawing unit 14.1.

In an adjacent drawing module a second drawing unit 14.2 is held which comprises several galette units 25 for drawing and thermofixing of two tapes each. In the drawing unit 14.2 the winding units 16.3 and 16.4 are disposed.

To each of the drawing units 14.1 and 14.2 a fiber brake 28 is assigned, with which a pre-tensing of the tape can be set.

Additional drawing units and winding units not represented here follow in the horizontal direction, where the design of the drawing units could be identical to that of the drawing unit 14.2 as well as to that of the drawing unit 14.1. There is however also the possibility of implementing drawing units with additional accessory devices.

In the additional embodiment, represented in FIG. 4, of the apparatus according to the invention a first tape group consisting of two tapes is fibrillated, drawn, and prepared in the drawing unit 14.1 before winding onto spools. In a second tape group, also with two tapes, each is wound onto a spool without additional treatment after the drawing. Additional tape groups not represented here can be processed in a manner identical to the processing of the first tape group or in a manner identical to the processing of the second tape group. There is however the possibility of processing and winding an additional tape group onto a spool in a different manner.

The process according to the invention and the apparatus according to the invention are distinguished in particular by the fact that tapes with different properties can be produced with as high a production speed as possible. Thus, from an extruded foil, tapes can be for different applications, such as, for example, for packaging fabric, for carpet backing, or for the production of strings, ropes, or cables. In particular, the individual treatment of the tapes leads to great flexibility in the production of tapes.

The invention claimed is:

1. A process for the production of tapes comprising the steps of forming an advancing web which is extruded by a single extruding device from a polymer melt, cooled, and drawn off, cutting the advancing web of the single extruding device to form a tape sheet comprising a plurality of tapes, dividing the tape sheet of the single extruding device into several groups of separate tapes which groups of separate tapes are then separately drawn, and then winding the tapes into packages.

2. The process of claim 1, wherein each group of tapes is drawn by setting parameters which are determined individually for each group.

3. The process of claim 1, wherein the groups of tapes are cut to individually determined cutting widths, with the tapes of each group having the same cutting widths.

4. The process of claim 1, wherein the tapes of each of the groups are drawn together, or in groups, or individually.

5. The process of claim 1, wherein at least one of the groups of tapes receives, before its drawing, during its drawing, or after its drawing at least one additional treatment.

6. The process of claim 5, wherein the additional treatment is a fibrillation, where the groups of tapes are guided as a group or individually over one or more spiked rollers.

7. The process of claim 5, wherein the additional treatment is a regulation of temperature, where the groups of tapes are heated as a group or individually.

8. The process of claim 5, wherein the additional treatment is a preparation, where the groups of tapes are dampened as a group or individually.

9. An apparatus for the production of tapes, comprising, a single extruding device for extruding an advancing web of polymeric material, a cooling device for cooling the advancing web, a draw-off unit for withdrawing the advancing web of the single extruding device from the cooling device, a cutting device for cutting the advancing web into a tape sheet comprising a plurality of separate tapes, a drawing device for separately drawing each of several groups of the separate tapes of the single extruding device which are separately divided from the tape sheet of the single extruding device, and a winding device for winding the drawn tapes into packages.

10. The apparatus of claim 9 wherein the drawing device comprises a plurality of separate drawing units which are driven and controlled independently of one another.

11. The apparatus of claim 10 wherein the winding device comprises a plurality of separate winding units, and wherein one or more of the winding units are assigned to each of the drawing units.

12. The apparatus of claim 11 wherein one of the winding units is assigned to each of the drawing units.

13. The apparatus of claim 10 wherein a brake device with which the advance of the tapes can be adjusted, is assigned to each of the drawing units.

14. The apparatus of claim 10 wherein each of the separate drawing units comprises several rollers or a godet unit consisting of a godet roller and associated roller with at least one of the godet roller and associated roller being heated.

15. The apparatus of claim 14 wherein the godets and godet units of the drawing units are held one next to another and/or one over another on a wall of a supporting frame.

16. The apparatus of claim 15 wherein the supporting frame is formed by a plurality of modules, where the modules are formed as carriers for drawing units and as carriers for winding units.

17. The apparatus of claim 9 wherein a fiber guide bar with a plurality of fiber guides is disposed after the cutting device, with which fiber guide bar a separation of the tapes can be carried out.

18. The apparatus of claim 9, wherein to at least one part of the drawing unit an additional treatment device is assigned.

19. The apparatus of claim 18, wherein the treatment device comprises a spiked roller for the fibrillation of the tapes, where the tapes are guided on the circumferential surface of the spiked roller.

20. The apparatus of claim 18, wherein the treatment device comprises a preparation device for preparing the tapes.

21. The apparatus of claim 9, wherein the cooling device is formed as a cooling bath and that several deflecting rods or deflecting rollers are assigned to the cooling bath, with which deflecting rods or deflecting rollers the web is guided, with several partial enwrapments, after being drawn off from the cooling bath.

* * * * *